US009751667B2

(12) United States Patent
Guery et al.

(10) Patent No.: US 9,751,667 B2
(45) Date of Patent: Sep. 5, 2017

(54) ADAPTER FOR CONTAINERS

(71) Applicant: BNOVA sprl, Wierde (BE)

(72) Inventors: Jean-Claude Guery, Wierde (BE); Corinne Herlin, Strasbourg (FR)

(73) Assignee: BNOVA SPRL, Wierde (BE)

( * ) Notice: Subject to any disclaimer, the term of this patent is extended or adjusted under 35 U.S.C. 154(b) by 236 days.

(21) Appl. No.: 14/359,790

(22) PCT Filed: Oct. 22, 2012

(86) PCT No.: PCT/EP2012/070847
§ 371 (c)(1),
(2) Date: May 21, 2014

(87) PCT Pub. No.: WO2013/079256
PCT Pub. Date: Jun. 6, 2013

(65) Prior Publication Data

US 2014/0305817 A1 Oct. 16, 2014

(30) Foreign Application Priority Data

Nov. 28, 2011 (BE) ..... 2011/0689

(51) Int. Cl.
*B65D 25/08* (2006.01)
*B65D 51/28* (2006.01)
(Continued)

(52) U.S. Cl.
CPC ..... *B65D 51/2892* (2013.01); *A61J 9/00* (2013.01); *A61J 1/2093* (2013.01)

(58) Field of Classification Search
CPC B65D 51/28; B65D 51/2807; B65D 51/2814; B65D 51/2821; B65D 51/2828;
(Continued)

(56) References Cited

U.S. PATENT DOCUMENTS 5,419,445 A 5/1995 Kaesemeyer
5,638,968 A 6/1997 Baron et al.
(Continued)

FOREIGN PATENT DOCUMENTS

EP 1527766 A2 5/2005
FR 2931807 A1 12/2009
GB 2462838 A 2/2010

OTHER PUBLICATIONS

International Search Report for PCT Application No. PCT/EP2012/070847 dated May 22, 2013.

*Primary Examiner* — Steven A. Reynolds
*Assistant Examiner* — Javier A Pagan
(74) *Attorney, Agent, or Firm* — Norris McLaughlin & Marcus, P.A.

(57) ABSTRACT

The present invention concerns an adapter (1) which is suitable to be mounted on and to cooperate with the neck (7) of a container (3) in order to allow a product contained in the adapter (1) to flow out into the interior of said container (3), said adaptor including:

at least one tank (4) which is suitable to contain said product, said tank (4) having a first opening (2) which is suitable to transfer said product from the tank (4) into the interior of the container (3), a single-use or reversible movable means for sealingly closing (5) the first opening (2), a means for activating (25) the movable means for sealingly closing (5) so as to allow said movable means for sealingly closing (5) to open and said product contained in the tank to flow out into the interior of the container (3).

The present invention also relates to a container comprising said adapter and to a method for preparing and/or serving a liquid.

11 Claims, 7 Drawing Sheets

(51) Int. Cl.
*A61J 9/00* (2006.01)
*A61J 1/20* (2006.01)

(58) Field of Classification Search
CPC ..... B65D 51/2835; B65D 51/2842; B65D 51/285; B65D 51/2857; B65D 51/2864; B65D 51/2871; B65D 51/2878; B65D 51/2885; B65D 51/2892
USPC ..... 206/219, 220, 221, 222
See application file for complete search history.

(56) References Cited

U.S. PATENT DOCUMENTS

| | | | | |
|---|---|---|---|---|
| 6,840,373 | B2 * | 1/2005 | Gibler | B65D 51/2842 206/219 |
| 2005/0194341 | A1 | 9/2005 | Houraney | |
| 2005/0211579 | A1 * | 9/2005 | Makita | B65D 51/2878 206/219 |
| 2009/0321286 | A1 * | 12/2009 | Frutin | B65D 51/2892 206/219 |
| 2011/0226770 | A1 | 9/2011 | Tiesberger | |
| 2015/0266634 | A1 * | 9/2015 | Yang | B65D 51/2892 206/221 |

* cited by examiner

ADAPTER FOR CONTAINERS

This application is a 371 application of PCT/EP2012/070847 filed Oct. 22, 2012, which claims foreign priority benefit under 35 U.S.C. §119 of Belgium Application No. BE 2011/0689 filed Nov. 28, 2011.

TECHNICAL SCOPE

The invention relates to the area of containers, notably containers containing a liquid product. More particularly, the invention relates to an adapter which can be arranged on a container allowing a solution to be prepared in situ.

DESCRIPTION OF THE PRIOR ART

Food or non-food formulations in the form of powder or fluid are very widespread. Said formulas must be stored and prepared under strict conditions of hygiene or safety. Formulations in the form of powder or fluid can be arranged in packaging separated from the contents in which they will subsequently be diluted or dispersed. For example, the formulation can be arranged in sealed packaging, such as a sachet, said latter being opened in order to release the powder or the fluid into a container such as a bottle. Said handling is generally carried out by the end user and implies a risk of contamination of the water or the formulation.

Devices or containers comprising an independent tank for storing a formulation are known. For example, US20110226770 describes an adapter which is closed at its outer end and allows a fluid product to be distributed in a bottle.

US 2005194341 also makes known pre-filled disposable containers. Said containers notably comprise a disposable container and a removable tight membrane. Nevertheless, with said type of pre-filled containers the length of time the mixture is preserved is very limited.

Application GB2462838 thus makes known a container which comprises two compartments which are integral and movable with respect to one another, containing respectively the food formulation and the liquid in order to dilute the same. Nevertheless said device is difficult to market on a large scale since it is not adaptable to a large number of currently known containers. In the food sector, U.S. Pat. No. 5,419,445, FR2931807, U.S. Pat. No. 5,638,968 or EP1527766 also make known feeding bottles which comprise a tank which is suitable to contain powder. Said devices nevertheless have disadvantages such as, for example, the presence of elements which prevent or restrict the dispersion of the product contained in the tank into the container or from the container to the atmosphere.

There is therefore a need for a device which is suitable to be mounted on a container and allows a solution to be prepared in situ by mixing a product contained in the device, for example a fluid or a powder, with a liquid contained in the container, and which solves, at least in part, one or several of the aforesaid problems of the known devices.

BRIEF DESCRIPTION OF THE INVENTION

One aim of the invention is to allow a product to be distributed in a container in order to form a solution, then the solution obtained in this manner to be distributed to the outside of the container, for example to the atmosphere, under conditions that are compatible with the requirements of the product contained in the tank. For example, if the product is a food product the conditions will be compatible with the conditions of hygiene necessary to food use. If the product is not a food product, the tank allows said product to be isolated and contact between the user and said product to be limited. In particular, another aim of the invention is to supply an adapter which comprises a tank which is suitable to contain a product in the form of powder or fluid and allows the product to be released into the tank and/or from the tank to the atmosphere, whilst limiting the presence of elements that prevent the product flowing out into the tank or from the tank to the atmosphere.

According to a first aspect of the invention, an adaptor which is suitable to be mounted on and to cooperate with the neck of a container in order to allow a product which is contained in the adapter to flow out into the interior of said container is provided. Said adapter comprises:

- at least one tank which is suitable to contain said product, said tank having a first opening which is suitable to transfer said product from the tank into the interior of the container,
- a movable means for sealingly closing the first opening,
- a means for activating the movable means for sealingly closing which is suitable to open said movable means for sealingly closing and to allow said product contained in the tank to flow out into the interior of the container.

The movable means for sealingly closing can be single-use or reversible. In a preferred manner, the movable means for sealingly closing is single use. In a preferred manner, the movable means for sealingly closing forms a topological space that is homeomorphic to a disk. For example, the movable means for sealingly closing such as is shown in FIGS. 1*a* and 1*b* is homeomorphic to a disk since its continuous deformation allows for the formation of a disk. On the other hand, if the movable means for sealingly closing such as is shown in FIGS. 1*a* and 1*b* were to include a hole, for example at the junction point 53 or at the flaps 31, the continuous deformation of said object would not then be able to form a disk in view of the presence of the hole. In a preferred manner, the movable means for sealingly closing comprises a plurality of flaps, said flaps having their sides in common with the side of another flap of said plurality of flaps and the distal end of which forms a junction point to all of said plurality of flaps. In a preferred manner, said means for activating is the lower wall of the tank. In a preferred manner, the lower wall of the tank is suitable to exert a pressure on the proximal end of the flaps of said plurality of flaps. In a preferred manner, the activation of the movable means for sealingly closing can be made solely as a result of the pressure applied by the lower wall of the tank on the proximal end of the flaps. According to a preferred embodiment, said adapter can also comprise a second opening which is suitable to connect the interior of the container fluidically to the atmosphere when the adapter is mounted on the neck of the container. In a preferred manner, said second opening is suitable to connect the atmosphere fluidically to the interior of said container via said tank and via said first opening.

The adapter according to the present invention has the advantage of being able to be mounted on numerous containers such as bottles or flasks. The adapter allows the product contained in the tank to be kept under optimum conditions of preservation thanks to its tightness. The container can contain a liquid. When the adapter is mounted on the neck of a container, the adapter allows the product to flow out into the liquid contained in the container in order to form a solution. The adapter further allows the solution to flow out to the outside of the container, for example to the atmosphere. Thus, the user is able to drink the solution contained in the container without removing the adapter if the prepared solution is of food quality, or to pour the contents of the container into a second container without removing the adapter, which limits the risk of contact between the user and the product.

The adapter according to the present invention is therefore suitable to be mounted on the neck of a container. The adapter therefore includes the means necessary to fixing it on the neck of a container. Said means will be adapted to the configuration of the neck of the container, for example to the diameter thereof and/or to the thread thereof.

According to another aspect of the invention, the adapter is suitable to be mounted on and to cooperate with the neck of a container in order to allow a product which is contained in the adapter to flow out into the interior of said container, said adaptor including:

- at least one tank which is suitable to contain said product, said tank having a first opening which is suitable to transfer said product from the tank into the interior of the container,
- a movable means for sealingly closing the first opening,
- a means for activating the movable means for sealingly closing suitable to open said movable means for sealingly closing and to allow said product contained in the tank to flow out into the interior of the container, characterized in that said adapter comprises a second opening which is suitable to connect the interior of the container fluidically to the atmosphere when the adapter is mounted on the neck of the container. The adapter according to the present invention allows the product which is suitable to be contained in the tank to be released in a direct manner without any element preventing or limiting distribution.

The invention also relates to a container comprising an adapter according to the present invention mounted on the neck of said container. The adapter according to the present invention can easily be arranged on a large variety of containers.

According to another aspect, the adapter according to the present invention can be used to allow a product stored in the tank to flow out into a container containing a first liquid in order to form a solution with said first liquid, then for the subsequent flow of said solution out to the atmosphere.

According to another aspect, the present invention provides a method for preparing in situ and/or serving a liquid solution. The term "in situ" refers to the interior of the container. Said method comprises the stages of:

(a) making available a container which contains a given volume of a first liquid, (b) mounting an adapter according to the invention on the neck of said container, the tank of said adapter containing a given quantity of a product, (c) activating the means for activating the movable means for sealingly closing said adapter in order to connect the tank fluidically to the container (3).

(d) making the product contained in the tank flow out through the first opening into the interior of the container in order to form a solution with the first liquid, and (e) as an option, making the solution thus formed flow out through the second opening to the atmosphere.

In a preferred manner, the stage c) is realized by means of the lower wall of the tank.

DETAILED DESCRIPTION OF THE INVENTION

Figure 1A:
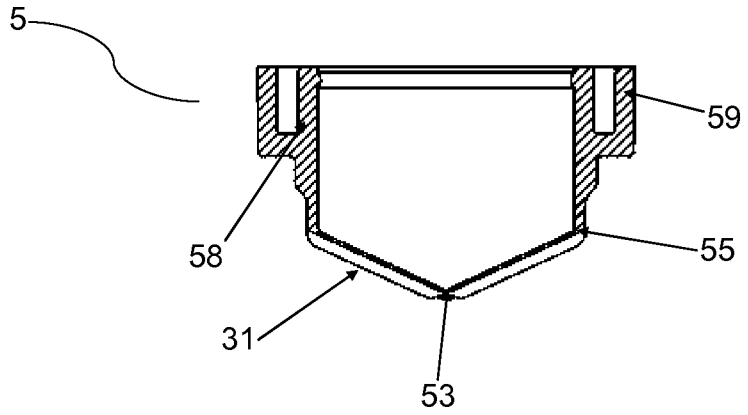
FIGS. 1*a* and 1*b* show a view of a movable means for sealingly closing according to a particular embodiment of the invention.

The present invention is defined by the accompanying independent claims. Preferred embodiments are defined in the dependent claims.

An adapter 1 is provided according to a first aspect of the invention. Said adapter 1 comprises at least one tank 4 which is suitable to contain a product, such as, for example, a fluid or a powder. When said adapter is arranged on the neck 7 of a container 3, it allows the fluid product or the powder to flow out into the interior of said container 3, in a preferred manner filled by a first liquid, in order to form a solution. Subsequently, said solution can flow out to the atmosphere through the intermediary of the tank 4 of said adapter 1. The adapter 1 can therefore remain mounted on the neck 7 of the container 3 even when a consumer wants to drink or pour the solution contained in the container 3. The absence of elements of the adapter or of the container blocking the passage of said product into the interior of the container or from the container to the atmosphere allows the distribution and therefore the dispersion of the product to be improved. Thus, the quantity of product present in the tank 4 is entirely or quasi entirely distributed in the container 3.

The adapter 1 according to the present invention is composed of a tank 4 which comprises a first opening 2, as well as upper walls 21 and lower walls 26 (cf. FIGS. 2, 3, 4 and 5). The first opening 2 allows the tank 4 to be connected fluidically to the container 3 when the adapter 1 is mounted on the neck of a container 3. Said first opening 2 is suitable to transfer the product that is suitable to be contained in the tank 4 into the interior of the container 3. Said adapter further comprises a second opening 16 which allows the interior of the container 3 to be connected fluidically to the atmosphere when the adapter is mounted on the neck of the container 3. So as to be able to mount the adapter on the neck 7 of the container 3, the adapter includes, for example, a thread 23 (shown in FIGS. 2, 3, 4 and 5), a bayonet, or any other system that is known and adapted for fixing said adapter on the neck of a container.

Figure 1B:
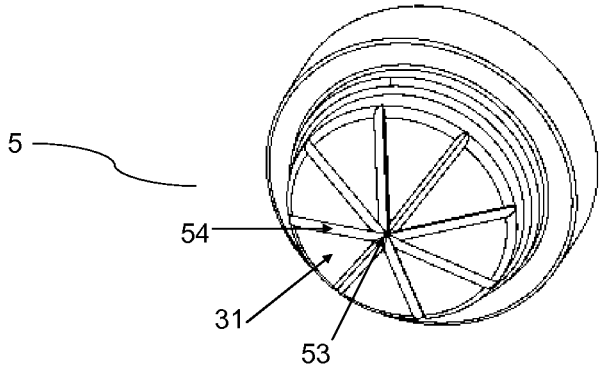

The adapter 1 according to the present invention further comprises a movable means for sealingly closing 5 the first opening 2 (FIGS. 1*a* and 1*b*). In a preferred manner, said movable means for sealingly closing 5 can control the closing and the opening of the first opening 2 in a reversible and reproducible manner. In a disposable version of the present adapter, the closing means 5 is no longer able to serve to re-close the first opening 2 once said first opening has been opened. The adapter is also provided with a means for activating 25 (not shown) the movable means for sealingly closing 5. Said means for activating 25 is suitable to open the movable means for sealingly closing 5 according to various possible mechanisms which will be explained below.

According to a preferred embodiment, said product flows out from the tank 4 into the interior of the container 3 as a result of gravity. As an alternative to this, the tank 4 can be a flexible material which is suitable to be compressed in order to force the product to flow out from the tank 4 into the interior of the container 3, for example through a valve produced in a resilient material.

In a preferred variant of the present invention, the movable means for sealingly closing 5 comprises at least one flap or a plurality of movable flaps 31. In the case where there would be several movable flaps 31, they are distributed in a preferred manner at angles around the axial direction of the adapter and are, in a preferred manner, simultaneously actuatable by means of a common activating means. In a single-use variant of the adapter according to the present invention, the flap or flaps 31 can be sufficiently fragile to be either pierced by a point or similar or to be torn by a cutting force or tractive force applied by the means for activating which are accessible from the outside of the adapter. So as to make it easier to control the opening of the flap or flaps by piercing or tearing and to be certain of the reproducibility thereof, it can be advantageous to provide the flaps with weakened lines, for example lines of reduced thickness, according to a model which allows the opening of the flap or flaps 31 to be promoted. As an alternative to this, the flap or flaps 31 can pivot about an axis, it being possible to define said latter by a weakened line in the flap.

Figure 2:
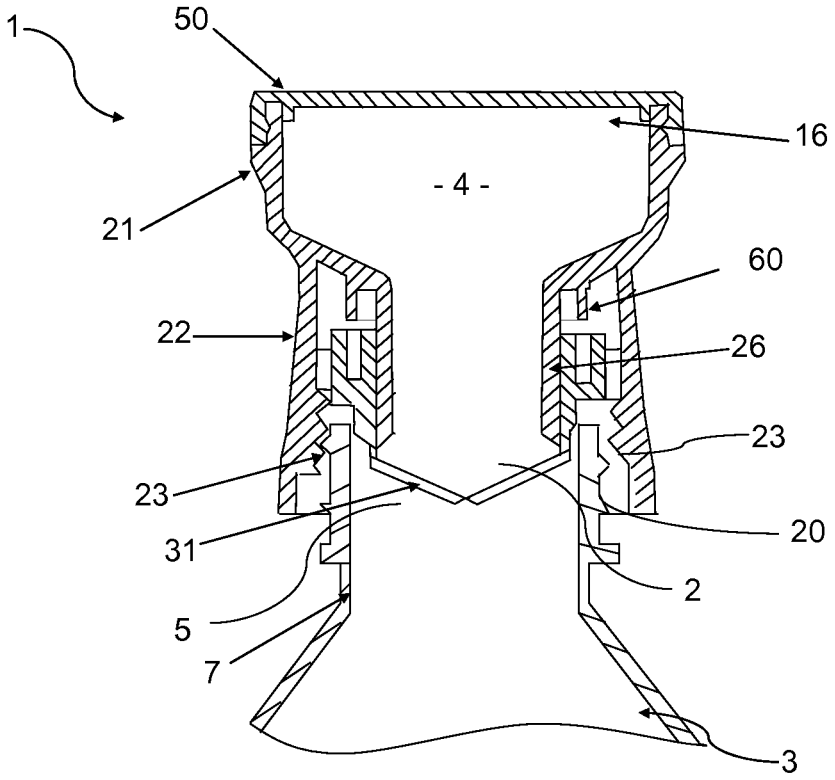
FIG. 2 shows a sectional view of an adapter according to a particular embodiment in a position ready for use and mounted on a container.
Figure 3:
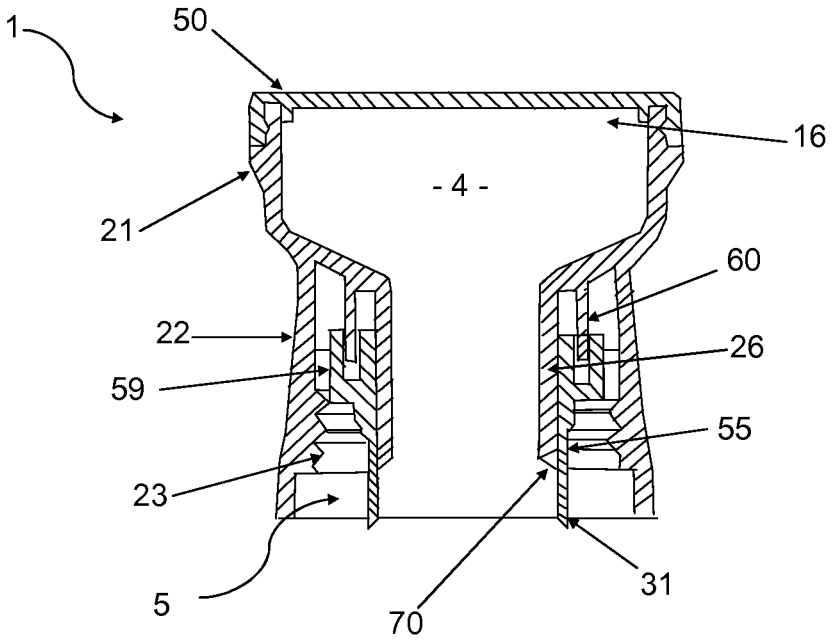
FIG. 3 shows a sectional view of an adapter according to a particular embodiment in a position after use, that is to say after the movable means for sealingly closing has been opened.

The type of means for activating the movable means for sealingly closing 5 obviously depends on the type of movable means for sealingly closing 5 used, examples of which have been discussed further above. In a preferred manner, they can be activated from the outside of the adapter. This can be effected either as a result of rotating one element of the adapter with respect to another along the axis of the adapter, or by pressing on a button, rotating a milled nut, activating a lever, or by any other system which allows the movement that is necessary to opening the movable means for sealingly closing 5 to be activated. In a preferred manner, the activation of the opening is effected by mechanically transferring the forces necessary to the opening of the movable means for sealingly closing 5 from the means for activating to said movable means for sealingly closing. The means for activating 25 can be, for example, the lower walls 26 of the tank 4 (FIG. 2). In this case, the pressure exerted on the flaps 31 by the lower walls 26 can cause the weakened lines arranged on the flaps 31 to rupture. The lower wall 26 of the tank 4 exerts a pressure on the proximal end of the plurality of flaps 31. In particular, as shown in FIG. 3, the distal end 70 of the lower wall 26 of the tank 4 is in contact with the proximal end 55 of the flaps 31 so as to activate the opening of the movable means for sealingly closing. The weakened lines arranged on the sides 54 of the flaps 31 rupture under the effect of said pressure and the flaps 31 will carry out a transverse movement with respect to their initial position. In fact, when the user screw-connects the adapter 1 onto the neck 7 of the container 3, this sets the means for activating 25 in motion. The tank 4 will be displaced, in a preferred manner vertically, in the direction of the movable means for sealingly closing 5, said latter being held in place with respect to the container 3, for example by means of a stop or an assembly which is fastened between the movable means for sealingly closing 5 and the neck 7 of the container 3. The lower wall 26 of the tank 4, in particular the distal end 70 thereof, then exerts a pressure onto the flaps 31 and causes the weakened lines arranged on the flaps 31 to rupture. Thus, once the movable means for sealingly closing have been activated and therefore once the tank has been opened, the flaps will be arranged in a manner parallel to the lower wall 26 of the tank 4 (FIG. 3). As an alternative to this, the user can set the means for activating 25 in motion through the intermediary of the outer ring 22. The pressure exerted on said ring 22 by the user will, as before, cause the lower walls 26 of the tank 4 to move in the direction of the movable means for sealingly closing 5.

In a single-use variant, said movable means for sealingly closing 5 can form a topological space that is homeomorphic to a disk. Said moveable means for sealingly closing 5 comprises a plurality of flaps 31, said flaps 31 having their sides 54 in common with the side of another flap of said plurality of flaps 31. The sides 54 of the flaps 31 can include weakened lines which make it easier to separate the flaps 31 when the movable means for sealingly closing 5 is activated. The distal end 70 of each of the flaps 31 forms a junction point 53 for all said plurality of flaps 31 (FIGS. 1*a* and 1*b*). In a preferred manner, the junction point 53 can have different forms or dimensions. Thus, in a variant as an alternative to that shown in FIGS. 1*a* and 1*b*, the junction point can be a circular element. Said junction point 53, in a preferred manner, stays directly connected to one or several flaps 31 once the movable means for sealingly closing 5 has been activated 5, that is to say once said flaps 31 have been opened. Thus, it does not block the solution formed in the container leaving or does not contaminate said solution. In a preferred manner, the movable means for sealingly closing 5 also comprises side walls 58 connected to a ring 59. The ring 59 allows the movable means for sealingly closing 5 to be arranged on the tank 4. The ring 59 also promotes the cooperation between the adapter 1 and the neck 7 of the container 3. The flaps 31 are connected to the side walls 58 at their proximal end 55. In a preferred manner, even after activation of the movable means for sealingly closing, the flaps 31 remain connected to the side walls 58 of the movable means for sealingly closing 5 by means of their proximal end. Thus, no fragments contaminate the solution that may be contained in the container. Said movable means for sealingly closing 5 which forms a topological space that is homeomorphic to a disk has the advantage of providing a tightness that is strengthened with respect to other means described in the present application. Furthermore, it also enables the fluidic connection between the interior of the container 3 and the atmosphere to be improved when the adapter 1 is mounted on the neck 7 of the container 3. Said movable means for sealingly closing 5 is associated, in a preferred manner, with means for activating that are simple to use and to produce, that is to say the lower walls 26 of the tank 4, which provides a notable economic and industrial advantage.

The movable means for sealingly closing 5 cooperates with the tank 4. In fact, the side walls 58 of the closing means 5 can be arranged on the lower wall 26 of the tank 4.

The side walls 58 are connected to an outside ring 59 which makes cooperation with the tank 4 easier. In a preferred manner, a cooperating ring 60, which is arranged on the contour of the lower wall 26 of the tank 4, promotes the coupling between the movable means for sealingly closing 5 and the tank 4 (FIG. 2 and FIG. 3). In fact, the cooperating ring 60 is coupled between the side walls 58 of the closing means 5 and the outside ring 59 of said closing means 5. The lower wall 26 of the tank can thus exert a pressure on the proximal end 55 of the flaps 31 and allow the weakened lines 54 and the junction point 53 to tear. An adapter 1 according to a particular embodiment of the invention is shown in FIG. 2. The adapter 1 can comprise a second opening 16 (FIGS. 2 and 3). The second opening 16 of the tank 4 can be closed by a removable cover 50. The cover 50 can cooperate with the upper walls 21 of the tank 4. The cover 50 can thus cooperate with the upper walls 21 by means of fixing means known to the expert, for example a system of notches, or tapping, or threading or soldering. The removable cover 50 can be withdrawn and replaced by means for flowing out 10 as described in the present application. According to a particular embodiment, the single-use movable means for sealingly closing 5 therefore comprises a plurality of flaps 31 distributed at angles around the junction point 53 (FIG. 1*a* et 1*b*). The distal end 70 of each of the flaps 31 is in contact at a junction point 53. The flaps 31 comprise weakened lines arranged on the sides 54 so as to make it easier to release the product contained in the tank 4. Said embodiment allows the tightness of the tank 4 to be improved when said means for closing 5 cooperates with said tank. The weakened lines arranged on the sides 54 of the flaps 31 can be configured to break when a pressure is exerted just by the lower walls 26 of the tank 4 (FIG. 3).

FIG. 3 shows a sectional view of an adapter according to the invention in its open position, that is to say after activation of the movable means for sealingly closing. The displacement of the lower wall 26 of the tank 4 to the movable means for sealingly closing 5 has allowed the weakened lines 54 arranged between the flaps 31 of the movable means for sealingly closing 5 and at the junction point 53 to rupture. The flaps 31 cooperate with the lower wall 26 of the tank 4. The proximal end 55 of the flap 31 nevertheless remains connected to the side walls 58 of the means for sealingly closing 5. The activation of the movable means for sealingly closing 5 by the lower wall 26 of the tank 4 improves the dispersion of the product contained in the tank into the container and also from the container to the atmosphere. Thus, the adapter provides a wide non-obstructed opening which makes it easier for the product to pass into the container then from the container to the atmosphere.

In a re-usable or reversible variant of the adapter, the flaps can be mounted so as to be able to slide along a direction tangential to the surface defined by the perimeter of the first opening 2. In the reversible version, the flap can furthermore be provided with means to maintain its closed position such as a snap-fitting or the like. Such means are pointless in its disposable version. The movable means for sealingly closing 5 can also take the form of a blade shutter of the type used in photographic equipment. In another variant, the movable means for sealingly closing 5 comprises a one-way valve. In particular, the valve is produced in a resilient material, such as an elastomer, and comprises a first orifice at a first end which is fluidically connected to a second orifice at the second end by an internal passage which narrows from the first orifice toward the second orifice, said latter being held in a resilient manner in the closed state. In position, the larger-dimensioned first orifice is oriented toward the interior of the tank 4 and the second orifice in the closed position is oriented toward the outside, that is to say toward the interior of a container 3 when the adapter is fixed to the neck of a container 3. The passage of a fluid through the second orifice of the valve can be forced when the pressure of the fluid reaches a certain value.

Re-usable adapters are also possible. As discussed further above, re-usable or reversible movable means for sealingly closing 5 can be the sliding or pivoting flap type, the blade shutter type or the one-way valve type. It is obvious to the expert to select a method of opening which allows the sliding or the pivoting in the two directions of a flap 31 or the opening or closing of a blade shutter to be activated from the outside of the adapter. In a preferred manner, the opening and the closing of the flaps or shutter is activated by rotating an element outside the adapter along the axis of revolution of the adapter. The opening of a one-way valve can be activated by creating a sufficient difference in pressure between upstream and downstream of the normally closed second opening. The contents of the tank 4 can be made to flow out into the interior of the container 3 either by increasing the pressure in the tank 4, or by reducing the pressure in the container 3. The pressure in the tank can be increased by compressing a flexible wall of the tank 4. For example, in the case of a baby bottle, by compressing the nipple, while the third opening 9 situated at the end of said nipple is kept closed. If not the use of a flexible ball can be envisaged. Another means to increase the pressure in the tank is to displace a wall thereof along, for example, a thread, thus reducing the volume of the tank 4. If the displaced wall is also in contact with the interior of the container 3, the displacement of the wall increases the pressure in the tank 4 and reduces the pressure in the container 3, allowing the desired difference in pressure to be obtained more quickly. As an alternative to this, in the case of a one-way valve, the activating means 25 can be any element of the adapter 1 or of the tank 4 which is suitable to contact the walls of said valve and to exert a pressure on the same in order to allow said valve to open. In a preferred manner, the activating means 25 can be the lower walls 26 of the tank 4. Thus, when the adapter 1 is screw-connected onto the neck 7 of the container 3, the lower walls 26 of the tank 4 contact the walls of said valve and exert a pressure that is sufficient to move them apart and to allow the product in the interior of the container 3 to flow out. The valve can be held in the open position in this manner whilst the adapter 1 is mounted on the container 3. The valve can be re-closed when the adapter 1 is unscrewed or withdrawn, in part or completely, from the neck of the container.

As mentioned above, according to a preferred embodiment, the adapter can include a second opening 16 which is suitable to connect the atmosphere fluidically to the interior of the container 3 via the tank 4 and via the first opening 2. Thus, the liquid contained in the container 3 is not able to contact the atmosphere in an accidental manner before the first opening 2 is opened and said liquid is mixed with the contents of the tank 4. In this way, all risk of contaminating the liquid in the container 3 is prevented.

Figure 4:
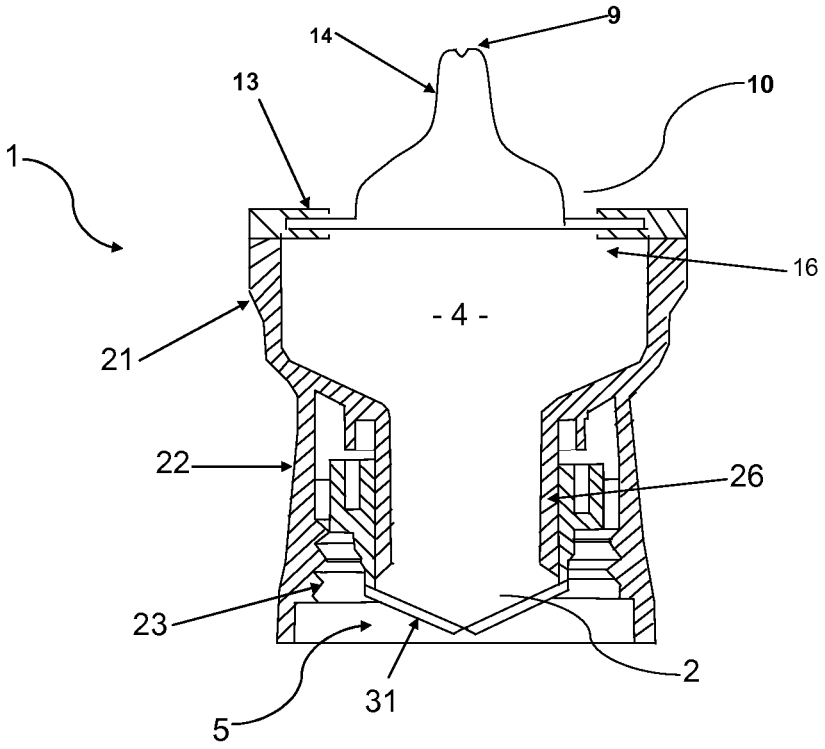
FIG. 4 shows a view in axial section of an adapter according to a particular embodiment of the invention with the tank in a closed position and comprising a nipple.
Figure 5:
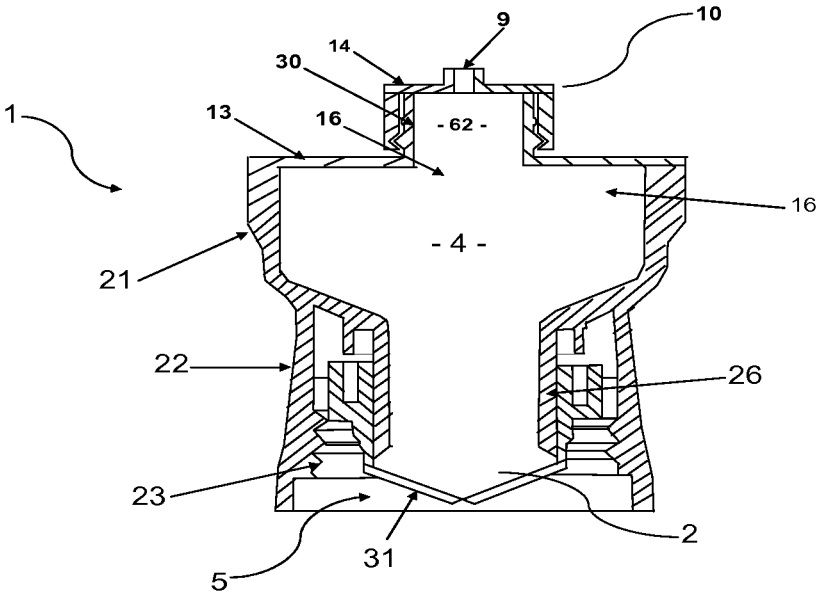
FIG. 5 shows a view in axial section of an adapter according to a particular embodiment of the invention with the tank in the closed position and comprising a removable plug.
Figure 6:
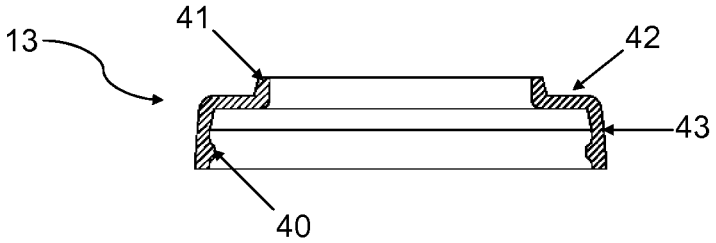
FIGS. 6 and 7 show a tight fixing means according to a particular embodiment.
Figure 7:
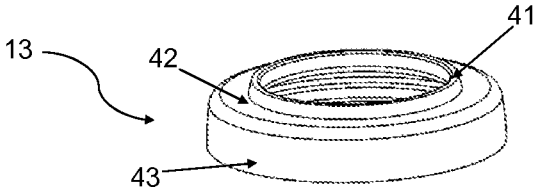

The second opening 16 can be shut-off by a removable cover 50 or provided with a means 10 that is suitable to control the outflow of said solution to the atmosphere. Said means for controlling the outflow 10 allows the flow of the outflow of the solution contained in the container 3 to the atmosphere to be cut and/or controlled by manipulation from an exterior surface of said means for controlling the outflow 10 (FIG. 4 and FIG. 5). The outflow of the solution to the atmosphere can also be effected by withdrawing the removable cover.

Said adapter 1 can comprise tight fixing means 13 of said means for controlling the outflow 10. Said fixing means 13 can be, for example, a system of male-female notches, a system of tapping and threading or a clip or a solder. The tight fixing means 13 promote the tightness between the second opening 16 and the means for controlling the outflow 10. In a preferred manner, said tight fixing means 13 are formed by a ring. For example, the ring 13 can be soldered to the top part 21 of the tank (FIG. 4). According to a particular embodiment, said tight fixing means 13 can be formed by a ring such as shown in FIGS. 3*a* and 3*b*. Said ring comprises a side wall 43 surmounted by an upper wall 42 which extends into the interior of the ring. The upper wall 42 can be connected to an edge 41 which extends to the exterior of the ring. On its lower part, the side wall 43 of the ring can comprise a tap 40 which is suitable to cooperate with a thread arranged on the upper walls 21 of the tank 4.

According to a preferred embodiment, said means for controlling the outflow 10 includes an outside part 14 which is provided with a third opening 9 in the distal position with respect to the second opening 16, connected fluidically to the second opening 16. Said third opening 9 can be provided with means for closing 62 the same. The means for closing 62 said third opening 9 can be a one-way valve.

According to a preferred embodiment shown in FIG. 5, said means for controlling the outflow 10 comprises a hollow tube 30 which includes an inner channel 62 which connects the third opening 9 fluidically to the second opening 16. Said outside part 14 can be, for example, suitable to slide along said tube 30 so as to shut-off or open the third opening 9 in order to form said closing means 62 (not shown) in this way. The outside part 14 and/or the hollow tube 30 can be provided with a one-way valve which blocks the third opening 9. The means for controlling the outflow 10 can also be surmounted by a removable plug or cap.

As an alternative to this, said means for controlling the outflow 10 can comprise an outside part 14 which is provided with a third distal opening 9 connected to the tight fixing means 13. Said closing means 62 can thus be a plug. As an alternative to this, said control means can be a spout.

According to another preferred embodiment, said means for controlling the outflow 10 is a teat such as shown in FIG. 4. Said teat can be surmounted by a plug which is suitable to exert a pressure on the distal end of said teat to further the tightness of the third opening 9.

Figure 9:
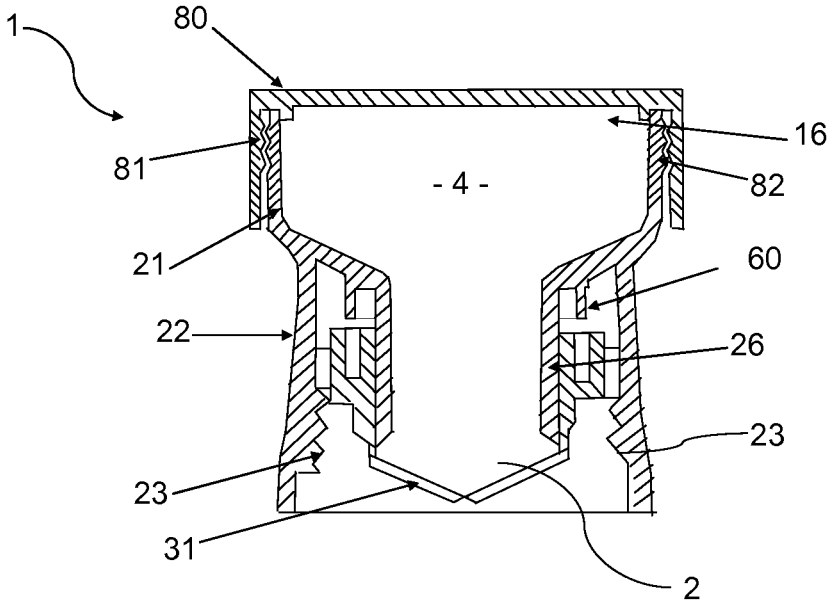
FIG. 9 shows a sectional view of an adapter provided with a tight cover which is non-removable with respect to the adapter according to a particular embodiment of the invention.
Figure 10:
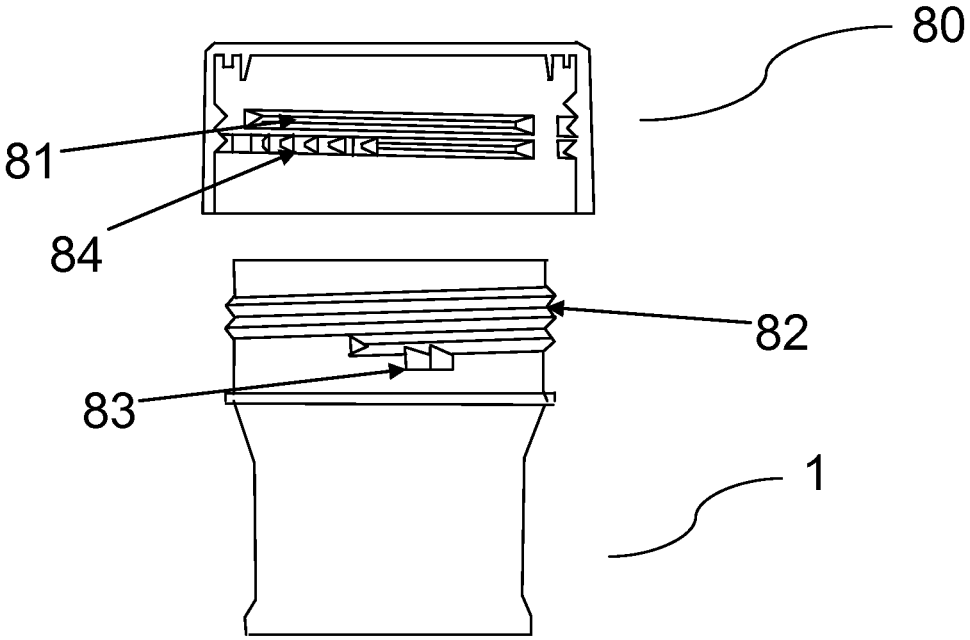
FIG. 10 shows a sectional view of the inside surface of the non-removable tight cover and an outside view of the adapter 1 according to a particular embodiment.

According to a particular embodiment, the adapter 1 can comprise a tight cover 80 which is fixed in a non-detachable manner to the upper wall 21 of the tank 4 (FIG. 9). The cover 80 can be screw-connected on the adapter 1 by means of a thread and tap device 81, 82. The thread device 82 can be arranged on the outside surface of the upper wall 21 of the tank 4 (FIG. 9) and the tap 81 can be arranged on the inside surface of the cover 80, such as shown in FIGS. 9 and 10 in order to coincide with said thread 82. The movable means for sealingly closing is such as described above. The tank can have a large capacity, for example 20 ml. The non-detachable cover 80 and the upper wall 21 of the tank 4 can be fixed together so that the cover 80, once screw-connected, can no longer be removed or unscrewed. This is obtained by the presence of one or several lugs 84 arranged on the inside surface of the non-detachable cover 80 (FIG. 10). Said lug or said several lugs are positioned against a stop 83 (FIG. 10) arranged on the outside surface of the upper wall 21 of the tank 4. The combination of a lug and a stop forms a non-return mechanism which, in this way, prevents the cover 80 from being removed from the adapter 1 when said cover has been screw-connected onto the adapter 1. When the cover 80 is screw-connected on the outside surface of the upper wall 21 of the tank 4, the lugs 84 will fit and lock on the other side of the stop 83 thus preventing its withdrawal. The adapter 1 has reinforced tightness thanks to the combination of the cover 80 and the movable means for sealingly closing.

The adapter can be realized by molding a plastic material. As an alternative to this, constituent elements of the adapter can be in aluminum, soft steel, cardboard or any other material. In a preferred manner, only the outside surface of the adapter is in said material whilst the movable means for sealingly closing is in plastics material.

Figure 8:
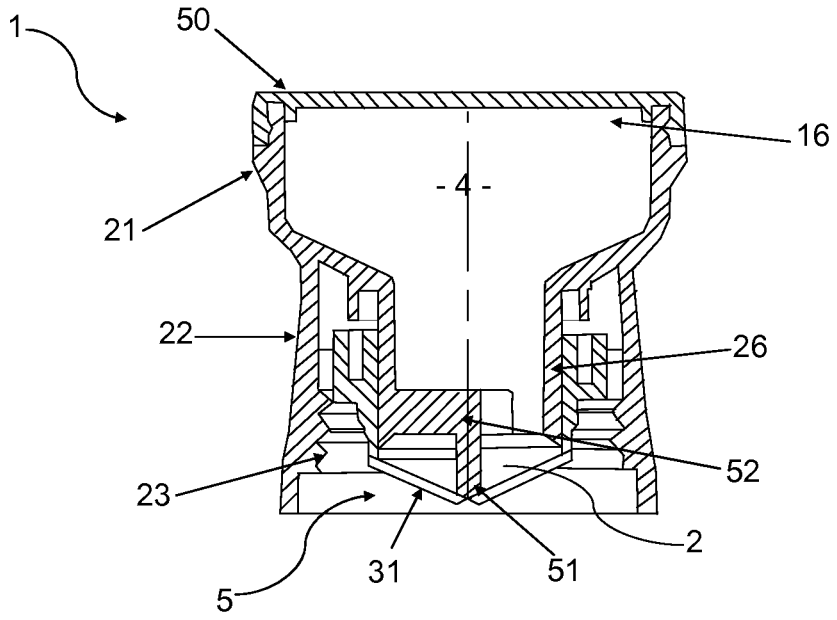
FIG. 8 shows a sectional view of an adapter according to another variant of the present invention.

According to another variant of the invention, the lower walls 26 of the tank 4, furthermore, can be connected to one or several arms 52 which extend into the interior of the tank 4. Said arm 52 is connected to a rod 51. The rod 51 extends in the direction of the movable means for sealingly closing 5, more particularly in the direction of the flaps 31 and/or of the junction point 53. The rod 51 can exert a pressure on the junction point 53 of the means for closing 5 (FIG. 8) and allow the fluid or liquid product inside the container to flow out once the weakened lines arranged on the flaps 31 have ruptured. Said rod can be in different forms in terms of the pressure which has to be exerted on the means for sealingly closing 5. The rod 51 can be a punch in order to exert a pressure on the junction point 53 or can have a more wide-mouthed form, such as a star, a cone or any other form likely to exert a pressure on said at least one flap 31 of the movable means for sealingly closing 5. The rod 51 can apply a supplementary pressure in order to accelerate the rupture of the weakened lines. In said particular embodiment, the arm 52 and the rod 51 are configured so that the product that is suitable to be contained in the tank can be released in a direct manner without any element preventing or limiting dispersion.

The variants discussed in the present application are particularly adapted to applications in the food or non-food area.

Said adapter 1, moreover, can comprise an adapting ring which allows it to be mounted on the neck 7 of containers 3 of different formats.

As an option, the adapter 1 can comprise a removable separating means between the at least one tank 4 and said second opening 16, for example a first cover. The adapter can also comprises, as an option, a cover which blocks off the lower part of said adapter 1 and is able to be withdrawn before said adapter 1 is arranged on the neck 7 of said container 3.

The adapter 1, which is suitable to be mounted on and to cooperate with the neck 7 of a container 3 in order to allow a product which is suitable to be contained in the adapter 1 to flow out into the interior of said container 3, can include:

- at least one tank 4 which is suitable to contain said product, said tank 4 having a first opening 2 which is suitable to transfer said product from the tank 4 into the interior of the container 3 and a lower wall 26,
- a movable means for sealingly closing 5 the first opening 2,
- a means for activating 25 the movable means for sealingly closing 5 so as to allow said movable means for sealingly closing 5 to open and said product contained in the tank to flow out into the interior of the container 3, characterized in that, said movable means for sealingly closing 5 forms a topological space which is homeomorphic to a disk and includes weakened or rupturing lines which are suitable to rupture under the pressure exerted by the activating means 25 and hinge lines which are suitable to be displaced under the pressure exerted by the activating means 25. The weakened or rupture lines intersect in a preferred manner at a junction point 53. The weakened or rupture lines and the movable hinge lines together form the contour of a flap 31. The weakened lines can be common to several flaps 31. The hinge lines are situated in a preferred manner on the proximal end 55 of a flap 31. These latter allow said flap 31 to be connected to the side wall of the mobile means for sealingly closing 5.

A container 3 is provided according to a second aspect of the invention. Said container 3 includes an adapter 1 according to the present invention mounted on the neck 7 of said container 3. A large variety of containers, adapters and products can be made available to consumers. In a preferred manner, said container 3 is a baby bottle, a can, a bottle or a flask for the consumption of drinks during a sporting activity, or a container for dosing and consuming medical or paramedical products such as vitamins, plant extracts, or any type of food product such as flavorings, tea, coffee, etc. As an alternative to this, said container 3 can be a bottle, a can or a flask for the use of a non-food product, for example a care product, a cleaning product or a cosmetic product.

According to a preferred embodiment, the adapter 1 is associated with a container 3, the neck 7 of which comprises at least one thread 20 and the upper walls 21 of the tank 4 are integral with an outside handling ring 22 which has an inner tap 23 which is suitable to cooperate with said thread 20 in order to screw-connect the adapter 1 on the neck 7 of the container 3 (FIG. 2).

According to a third aspect of the invention, said adapter 1 can be used for the outflow, in a container 3 containing a first liquid, of a product stored in the tank 4, in order to form a solution with said first liquid, then for the subsequent outflow of said solution to the atmosphere. The product stored in the tank 4 can be a food or non-food product. The present invention provides numerous possibilities thanks to the reinforced tightness of the movable means for sealingly closing 5, and therefore thanks to the reinforced tightness of the tank 4. The presence of the second opening 16, moreover, allows for a large amount of flexibility of use.

Following yet another aspect, the invention provides a method for preparing and serving a liquid solution, comprising the stages of:

(a) making available a container 3 which contains a given volume of a first liquid, (b) mounting an adapter 1 as claimed in the present invention on the neck 7 of said container 3, the tank 4 of said adapter 1 containing a given quantity of a product, (c) activating the means for activating 25 the movable means for sealingly closing 5 said adapter 1 in order to connect the tank 4 fluidically to the interior of the container 3, in a preferred manner by means of the lower wall 26 of the tank 4, (d) making the product contained in the tank 4 flow out through the first opening 2 into the interior of the container 3 in order to form a solution with the first liquid, and (e) as an option, making the solution thus formed flow out through the second opening 16 to the atmosphere.

The adapter of the present invention provides the advantage of allowing the preparation in situ of a liquid composition (solution or dispersion) under the best conditions of hygiene. The tank 4 can contain, apart from pharmaceutical components and food complements, food quality products suitable to be consumed in the liquid form by mixing said product with a liquid contained in the container 3. As an alternative to this, the product contained in the tank 4 can be non-food, for example a care product, a cleaning product or a cosmetic product. In said case, the tightness of the adapter 1, and particularly of the movable means for sealingly closing 5, allows the product to be conserved shielded from the atmosphere and the deterioration thereof to be avoided. If the product contained in the tank 4 is in concentrated form, thus presenting a risk for the user, the present invention will allow this latter to prepare a diluted solution without risk of contact. The diluted solution thus formed will be able to be used without any particular precaution.

The invention claimed is:

1. An adapter is suitable to be mounted on and to cooperate with a neck of a container in order to allow a product which is suitable to be contained in the adapter to flow out into an interior of the container, the adaptor comprises:

at least one tank that is suitable to contain the product, the tank having a first opening which is suitable to transfer the product from the tank into the interior of the container, upper walls and a lower wall, a movable means for sealingly closing the first opening, a means for activating the movable means for sealingly closing so as to allow the movable means for sealingly closing to open and the product contained in the tank to flow out into the interior of the container, wherein the movable means for sealingly closing forms a topological space that is homeomorphic to a disk and comprises at least one or a plurality of flaps, so that if the adaptor comprises a plurality of flaps, the flaps have their sides in common with the side of another flap of the plurality of flaps and the distal end of which forms a junction point to all of the plurality of flaps, and in that the means for activating the movable means for sealingly closing is the lower wall of the tank, wherein the lower wall of the tank is configured to exert, when the movable means for sealingly closing is activated, a pressure on a proximal end of the flaps, and in that the tank comprises an outer ring which is integral with the upper walls of the tank, wherein the outer ring of the tank is configured for cooperation with the neck of the container.

2. The adapter according to claim 1, wherein the movable means for sealingly closing and the means for activating are selected from:

a) the movable means for sealingly closing comprises a one-way valve in a resilient material that allows a flow to the outside of the tank to be controlled and the means for activating comprise a means to increase the pressure in the tank to a level sufficient to allow the product contained in the tank to flow out through the valve;

b) the movable means for sealingly closing comprises at least one flap that is able to slide tangentially to the surface which defines the perimeter of the first opening and the means for activating comprise means that are outside the adapter to actuate the sliding of said at least one flap into the open position;

c) the movable means for sealingly closing comprises at least one flap that is able to pivot along an axis of rotation parallel to the plane defined by the surface which defines the perimeter of the first opening and the means for activating comprise means outside the adapter to actuate the pivoting of the at least one flap into the open position; and d) the movable means for sealingly closing comprises a blade shutter and the means for activating further comprise means outside of the adapter to actuate the withdrawal of the blades or the removal of the blades from one another so as to open the shutter; or e) the movable means for sealingly closing comprises a one-way valve in a resilient material which allows a flow to an outside of said tank to be controlled.

3. The adapter according to claim 1, wherein the adapter comprises a second opening that is suitable to connect the atmosphere fluidically to the interior of the container via the tank and the first opening when the means for sealingly closing are open.

4. The adapter according to claim 3, wherein the second opening is provided with means for controlling an outflow to the atmosphere or is covered by a removable cover.

5. The adapter according to claim 4, wherein the means for controlling the outflow include an outside part that is provided with a third distal opening, connected fluidically to the second opening.

6. The adapter according to claim 4, wherein a nipple forms the means for controlling the outflow.

7. The adapter according to claim 4, wherein the means for controlling the outflow comprise a hollow tube that is suitable for connecting the third opening fluidically to the second opening and an outside part that is suitable to slide along the length of the hollow tube so as to seal or open the third opening.

8. A container comprising the adapter according to claim 1, wherein the adapter is mounted on a neck of said container.

9. The container according to claim 8, wherein the neck comprises at least one thread and in that the upper walls of the tank are integral with an outer handling ring that has an inner tap that is suitable to cooperate with the thread to screw-connect the adapter on the neck of the container.

10. The adapter according to claim 1, wherein said cooperation causes the lower wall of the tank to move in the direction of the movable means for sealing closing.

11. An adapter is suitable to be mounted on and to cooperate with a neck of a container in order to allow a product which is contained in the adapter to flow out into an interior of the container, the adaptor comprising:

at least one tank that is suitable to contain the product, the tank having a first opening that is suitable to transfer the product from the tank into the interior of the container, a movable means for sealingly closing the first opening, a means for activating the movable means for sealingly closing so as to allow the movable means for sealingly closing to open and the product contained in the tank to flow out into the interior of the container, wherein the movable means for sealingly closing is reversible, wherein the movable means for sealingly closing forms a topological space that is homeomorphic to a disk and comprises at least one or a plurality of flaps, so that if the adaptor comprises a plurality of flaps, the flaps have their sides in common with the side of another flap of the plurality of flaps and the distal end of which forms a junction point to all of the plurality of flaps, and in that the means for activating the movable means for sealingly closing is a lower wall of the tank, wherein the lower wall of the tank is configured to exert, when the movable means for sealingly closing is activated, a pressure on a proximal end of the flaps, and further wherein the tank comprises an outer ring which is integral with upper walls of the tank, wherein the outer ring of the tank is configured for cooperating with the neck of the container.

* * * * *